United States Patent [19]

Eastland

[11] Patent Number: 4,473,022

[45] Date of Patent: Sep. 25, 1984

[54] SAIL CONSTRUCTION

[76] Inventor: James J. Eastland, West Hills Rd., Ivoryton, Conn. 06442

[21] Appl. No.: 378,912

[22] Filed: May 17, 1982

[51] Int. Cl.[3] ..... B63H 9/08; B63B 15/02

[52] U.S. Cl. ..... 114/103; 114/39; 114/99; 114/102; 441/74; 280/810

[58] Field of Search ..... 114/103, 39, 102, 90, 114/315, 111, 97, 98, 99, 43; 180/180, 181; 280/11.115, 810, 811; 441/74, 75

[56] References Cited

U.S. PATENT DOCUMENTS

| | | | |
|---|---|---|---|
| 2,213,754 | 9/1940 | Thirring | 280/810 |
| 3,194,202 | 7/1965 | Saunders | 114/102 |
| 3,286,673 | 11/1966 | Nason | 114/39 |

FOREIGN PATENT DOCUMENTS

| | | | |
|---|---|---|---|
| 2604132 | 8/1977 | Fed. Rep. of Germany | 280/810 |
| 2738469 | 3/1979 | Fed. Rep. of Germany | 441/74 |
| 3004725 | 8/1981 | Fed. Rep. of Germany | 114/103 |
| 2448988 | 2/1979 | France | 280/810 |
| 2510510 | 2/1983 | France | 114/39 |
| 8000689 | 9/1981 | Netherlands | 114/90 |
| 2017596 | 10/1979 | United Kingdom | 280/810 |

OTHER PUBLICATIONS

PCT WO83/00311 Priority 7-1981 Pub 2-1983 Ordogh and Tatar (Hungary).

*Primary Examiner*—Trygve M. Blix
*Assistant Examiner*—Patrick W. Young
*Attorney, Agent, or Firm*—Delio and Libert

[57] ABSTRACT

A hand maneuverable sailing rig includes a sail construction having a mast, a sail attached thereto and a bowed, wishbone boom encircling the mast and sail. The wishbone boom is attached to the mast and sail by stays and tie lines. The mast is pivotably supported on mast support means and the resulting sail construction is a highly maneuverable, wind-propelled device suitable for use with roller or ice skates, skateboards or sailboards.

11 Claims, 6 Drawing Figures

SAIL CONSTRUCTION

BACKGROUND OF THE INVENTION

The present invention relates generally to sailing rigs and more particularly to a hand-manipulated sailing rig for use with skates, sailboards or like devices to provide a wind-propelled construction.

Hand-held or hand-manipulated sailing rigs are well known and can be conveniently classified into two general types, these being the hand-held, fixed sail and the hand-manipulated marine style sail. The first type, the hand-held or fixed sail, is entirely supported by being hand held by the user. Exemplary of such devices are the wind sails described in U.S. Pat. Nos. 4,269,133 and 3,924,870 which way of a mast, to a wind-propelled board such as a sailboard. Typical sail rigs of this latter type are disclosed in U.S. Pat. Nos. 4,311,107 and 4,253,209; British Pat. No. 1,551,426 and; German Pat. Nos. 2,912,867 and 2,712,018.

German Pat. No. 2,912,867 and British Pat. No. 1,551,426 each disclose a marine construction which includes a sail attached to a vertically extending mast which is secured to the sailboard. Each construction further includes a bowed boom which is either rigidly or pivotally attached to the mast at its forward end and attached to the trailing edge of the sail at its aft end. These bowed booms encircle the sail and serve as a hand hold for manipulating the sail. The masts of these two constructions are both completely unstayed.

German Pat. No. 2,712,018 discloses a sailboard or windsurfer having a mast attached to the board with a straight pole boom pivoted at its forward end to the mast and connected to the trailing edge or clew of the sail by a tie line at its aft end. A stay extends downwards from the aft end of the boom to the mast base and a pair of hand lines extend on either side of the sail from the boom to the mast to provide hand-held means to control the sailboard.

The above-mentioned hand-held and board mounted sails suffer from certain inherent shortcomings. The hand-held fixed sails of the first-mentioned type do not provide the wind advantage nor the maneuverability of a marine mainsail configuration under various wind conditions, particularly when sailing against the wind. On the other hand, the marine board sails of the second mentioned type also possess certain inherent deficiencies, particularly as to the rigidity and stability of their mast rigging and in respect of their limited ability to sail a course close to an oncoming wind.

The present invention overcomes certain shortcomings encountered with prior hand-held and hand-manipulated sail rigs by providing a sail construction which is highly responsive and maneuverable under varying wind conditions and wind directions. The sail construction of the present invention is adapted to be used as a hand-held, supported mast wind sail, the mast being supported by roller or ice skate or by a riding board such as a sailboard (i.e., a wind-powered surfboard), or a skateboard.

The present invention further provides a sail construction with enhanced mast and boom stability. In addition, the present invention provides greater boom maneuverability, thus providing improved sail set ability under a variety of wind conditions.

SUMMARY OF THE INVENTION

In accordance with the present invention, there is provided a sail construction as follows:

A longitudinally extending mast has an upper end portion, a lower end portion and a central portion therebetween and a sail has its luff portion attached to the mast, and trailing edges extending rearwardly from the luff portion to a rear apex. A boom extends from forward of the mast to aft of the rear apex of the sail, the boom having a forward end region disposed forward of the mast and an aft end region disposed aft of the rear apex. A first tie line connects the luff portion of the sail to the forward end region of the boom and a second tie line connects the rear apex of the sail to the aft end region of the boom. Stays connect the upper end portion and the lower end of the mast to the boom and pivoting means are associated with the mast to permit pivoting of the sail about the longitudinal axis of the mast. Mast support means receive the lower end portion of the mast, to support the same during use.

In accordance with one aspect of the invention, the boom comprises a boom frame having opposed outwardly extending side members whose opposite ends terminate in the forward and aft end regions, the boom frame being disposed transversely of and encircling the mast and the sail. Preferably, the pivoting means comprises a pivoting connection between the mast and the mast support means whereby the mast and the sail may pivot about the longitudinal axis of the mast. The pivoting means may comprise a universal joint.

In a preferred aspect, the invention provides a pair of upper stays and a pair of lower stays, wherein the pair of upper stays connects the upper end portion of the mast to respective opposite side members of the boom frame and the pair of lower stays connects the lower end portion of the mast to respective opposite side members of the boom frame.

In one aspect of the present invention, the sail construction further includes a body portion on which the mast support means is received. The body portion may comprise a skate and the mast support means may have an inverted U-shape configuration and be dimensioned and configured to be mounted upon the skate and to receive a user's foot within the inverted U-shape configuration. Alternatively, the body portion may comprise a riding board.

DETAILED DESCRIPTION OF PREFERRED EMBODIMENTS OF THE INVENTION

Figure 1:
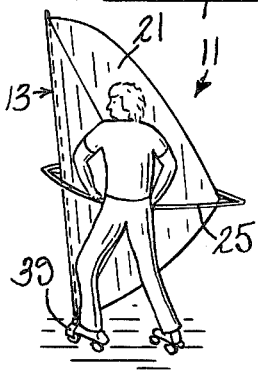
FIG. 1 is a perspective view showing the sail construction of the present invention in use with roller skates.
Figure 2:
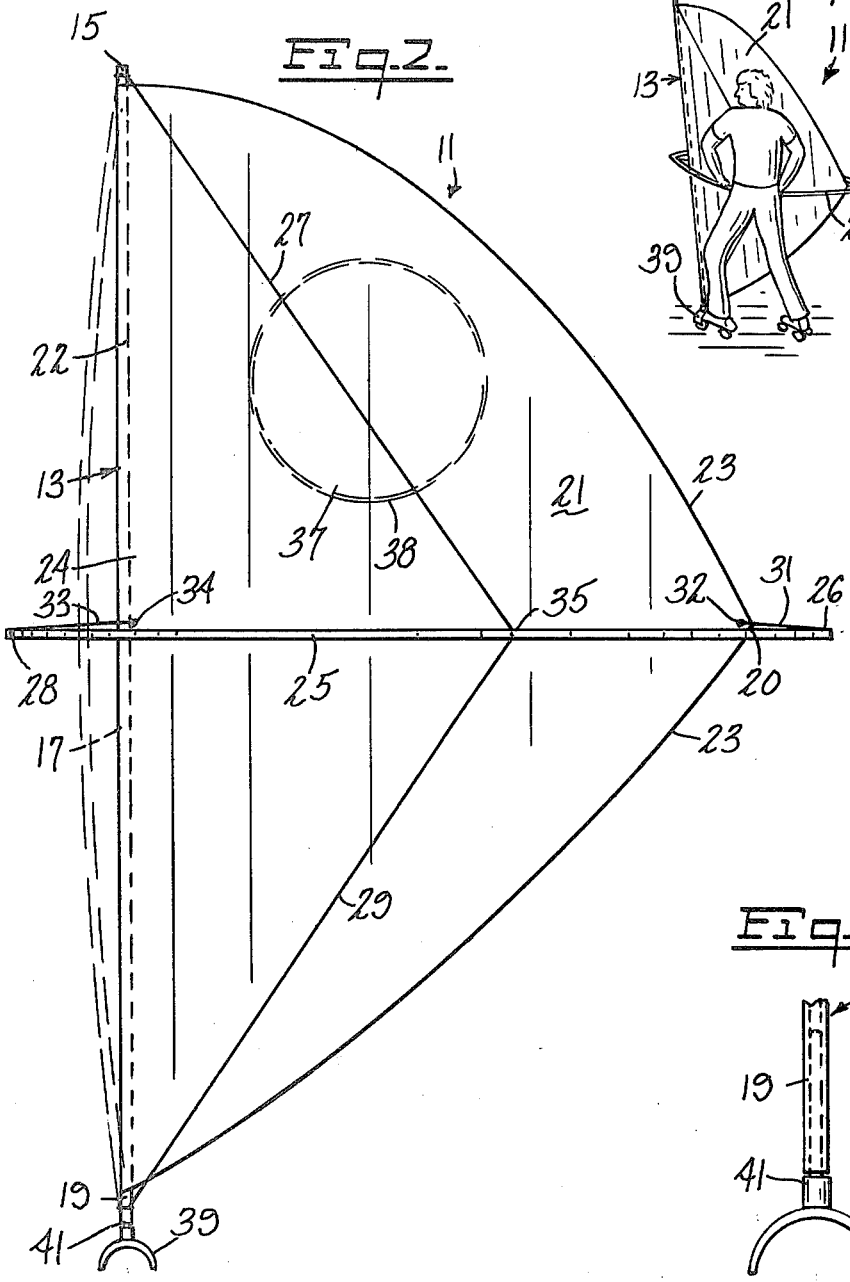
FIG. 2 is a side elevation view of a preferred embodiment of the sail construction of the present invention.
Figure 3:
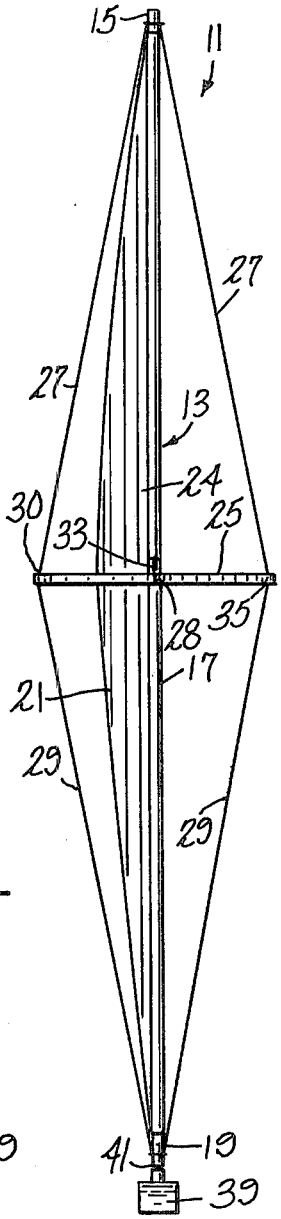
FIG. 3 is an aft (rear) elevation view of the sail construction shown as FIG. 2.

Referring now, more specifically to the drawings and in particular FIGS. 1–5, a sail construction generally designated 11 and comprising an embodiment of the present invention is shown. FIG. 1 shows the sail construction 11 in use in combinations with roller skates as a body portion to receive the mast support means. However, it will be appreciated that this same embodiment could also be used with any other foot-worn sliding or rolling means serving to receive the mast support means, and thereby support the sail construction and enable wind-propelled travel by the user. As used herein and in the claims, the term "skate" includes a roller skate, ice skates, ski and the like. Further, as discussed below with respect to FIG. 6, instead of a foot-worn device such as a skate, the body portion of the device may comprise a "riding board" which term is used herein and in the claims to include devices designed to be stood upon by the user, such as sailboards, skateboards, skiboards (by which is meant a small toboggan-like board for snow or ice) and the like.

The sail construction 11 includes a vertically extending mast 13 having an upper end portion or mast head 15, a lower end portion or mast base 19 and a mid-section 17 therebetween. The mast 13 is preferably constructed of a material which will flex somewhat under load as shown by the dashed line drawing of mast 13 in FIG. 2. In this regard, mast 13 is preferably constructed of tubular aluminum or fiberglass, however, any other suitable and preferably light weight, strong, yet flexible materials could be utilized. Attached to mast 13 along its length is a sail 21. The sail 21 is preferably constructed of a conventional, light weight sail material, such as nylon although any other suitable materials such as plastic film or other synthetic weaves could be used, depending upon their strength, weight and cost. The sail 21 is generally triangular in shape having its longest side or luff 24 secured to the mast 13 by a sewn seam 22. The sail 21 also includes a pair of trailing edges 23 extending from the luff 24 to a point of convergence at a rear apex 20. The trailing edges 23 are cut such that they define an outward or convex bow between the luff 24 and the apex 20 so as to improve the efficiency of the sail 21 due to the increase in sail area provided thereby. The sail 21 is also fitted with a window 37 of clear plastic or other transparent material which is held in place by a stitched seam 38 or the like. The window 37 permits the user to visually observe any objects which may be on the leeward side of the sail 21 and to react accordingly.

Figure 4:
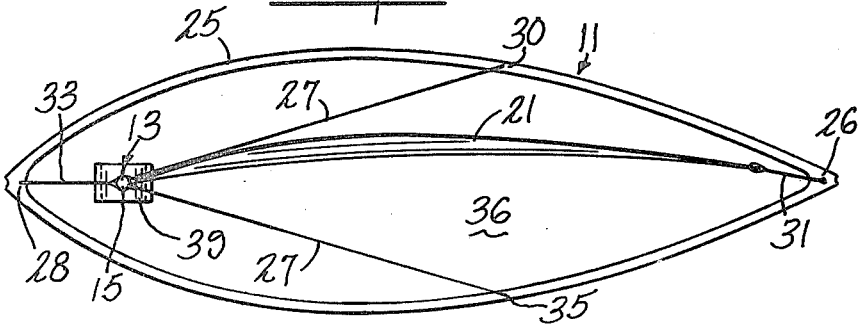
FIG. 4 is a plan view of the sail construction of FIG. 2.

Encircling the mast 13 and sail 21 is a wishbone boom 25 which, as will be explained in greater detail hereinafter, serves as the maneuvering means and hand hold for the user. The boom 25 is generally oval shaped in plan view with an open interior 36 and a bowed mid-section so as to minimize any interference between the leeward side of the boom 25 and the sail 21 when it is under wind, as best seen in FIG. 4. The boom 25 is preferably also constructed of a light weight, strong material such as tubular aluminum, plastic, fiberglass, wood or the like.

The wishbone-style boom 25 is attached to the mast head 15 by a pair of upper stays 27. The stays 27 are secured at their lower ends to the boom 25, one at tieing point 30 on the starboard side of the boom 25 and the other at tieing point 35 on the port side thereof. In similar fashion, a pair of lower stays 29 are secured to and extend from the lower end 19 of the mast 13 to tieing points 30 and 35 on the boom 25, FIGS. 3–4. The upper and lower stays 27 and 29, respectively, may be nylon cord, braided wire or any other suitable material, preferably of similar high tensile strength.

The boom 25 is also attached to the sail 21 by tie lines at its forward and aft end regions 28 and 26, respectively. A rear tie line 31 is secured at the rear apex 20 of the sail 21 through a tie hole 32 and to the aft end 26 of the boom 25. A forward tie line 33 is secured to the forward end region 28 of the boom 25 and to a tie hole 34 in the sail 21 adjacent to the luff 24 at the mid-section 17 of the mast 13. Tie lines 31 and 33 may be of conventional nylon rope or cord.

Hence, in the rigged states, the wishbone boom 25 is fastened to mast 13 only by cord tie-lines and stays; there is no mechanical pivoting or other rigid, though moveable, connector means employed. Consequently, boom 25 controls the flex of the mast 13 through its stays 27 and 29 while allowing the attainment of the desirous sail shape through line 33 and/or line 31. It can also be appreciated that the upper and lower stays 27 and 29, respectively, serve to render the mast 13 much more rigid under wind, thus giving the user a greater ability to maneuver and control the sail shape in relationship to the wind. Since the stays 27 and 29 are attached to the end portions of the mast, 15 and 19, and to the boom 35, the wind forces on the sail are essentially transformed through these stays directly to the boom. The stays 27 and 29 essentially prevent an adverse change of mast flex and adverse change of sail shape. Consequently, the desired resultant forces are achieved and far more efficiently directed to the boom than those forces resulting from the unstayed sailing rigs whereas the boom is attached only to the leading edge of the mast.

Figure 5:
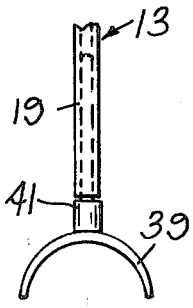
FIG. 5 is an enlarged, fragmentary side elevation view of the mast support means of the sail construction of FIG. 2.

As previously stated, one embodiment of the present invention utilizes a skate as the body portion for skate sailing and, in this regard, the lower end 19 of the mast 13 has an inverted U-shaped member 39 attached thereto. As can be seen in FIG. 5, the mast support member 39 is pivotally secured to the mast base 19 by way of a pivot coupling 41. The mast support member 39 rests on the shoe of the skate, in the manner shown in FIG. 1, while the skater grasps the wishbone boom 25. In this manner, the mast 13 is vertically supported and laterally stabilized by the support member 39 thus permitting the user to maneuver the sail 21 in a manner similar to marine sails. In this regard, the sail construction of the present invention is far superior to the prior fixed, hand-held skate sails, particularly when sailing into the wind. With prior skate sails, it has been either impossible or highly ineffective to attempt such a sailing maneuver. Obviously, means (not shown) may be utilized to secure or lock member 39 to the skate, preferably with a safety release in case of accidents. Equally obviously, the user may use a second skate on his other foot, to facilitate travel.

Figure 6:
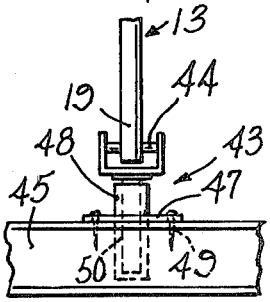
FIG. 6 is an enlarged, fragmentary side view of the lower end portion of the mast of another embodiment of the present invention including, a riding board on which said mast is mounted.

Referring now to FIG. 6, the sail construction of the present invention can easily be modified to include as the body portion any suitable riding board, such as sailboards, skiboards, skateboards, as mentioned above. In place of the previously described mast support member 39 is a universal joint 43. The mast lower end portion 19 is attached to universal joint 43 by a pin 44. Universal joint 43 is mounted to the board 45 by a mounting plate 47 which is secured to the board 45 by any suitable means such as clamps, screws 49 or like fasteners. A hollow post receptacle 48 affixed to plate 47 is recessed within board 45 to receive the lower stub extension 50 of universal joint 43. Universal joint 43 could be of any suitable type, such as a ball and socket type universal joint. In this manner, the mast 13 is free to pivot and rotate about its vertical axis in order to accomodate any movement caused by the stays 27 and 29 or the tie lines 31 and 33.

What is claimed is:

1. A sail construction comprising:
(a) a longitudinally extending mast having an upper end portion, a lower end portion and a central portion therebetween;
(b) a sail having a luff portion attached to the mast and trailing edges extending rearwardly from the luff portion to a rear apex;
(c) a wishbone boom extending from forward of said mast to aft of said rear apex of said sail, said boom having a forward end region disposed forward of said mast, an aft end region disposed aft of said rear apex, and intermediate portions therebetween;
(d) a first tie line connecting the luff portion of said sail to the forward end region of said boom and a second tie line connecting the rear apex of said sail to the aft end region of said boom; and
(e) stays connecting the upper end portion and the lower end portion of said mast to the intermediate portions of said boom.

2. The sail construction of claim 1 further including pivoting means associated with said mast to permit pivoting of said sail about the longitudinal axis of said mast.

3. The sail construction of claim 1 or 2 further including mast support means receiving the lower end portion of said mast to support the same during use.

4. The sail construction of claim 1 wherein said boom comprises a boom frame having opposed outwardly extending side members whose opposite ends terminate in said forward and aft end regions, said boom frame being disposed transversely of and encircling said mast and said sail.

5. The sail construction of claim 2, wherein said pivoting means comprises a pivoting connection between said mast and said mast support means whereby said mast and said sail may pivot about the longitudinal axis of said mast.

6. The sail construction of claim 5 wherein said pivoting means comprises a universal joint.

7. The sail construction of claim 4 including a pair of upper stays and a pair of lower stays and wherein said pair of upper stays connects the upper end portion of said mast to respective opposite side members of said boom frame and said pair of lower stays connects the lower end portion of said mast to respective opposite side members of said boom frame.

8. The sail construction of claim 1, 2, or 4 further including a body portion on which said mast support means is received.

9. The sail construction of claim 8 wherein said body portion comprises a skate and said mast support means has an inverted U-shape configuration and is dimensioned and configured to be mounted upon the skate and to receive a user's foot within the inverted U-shape configuration.

10. The sail construction of claim 8 wherein said body portion comprises a riding board.

11. A sail construction comprising:
(a) a longitudinally extending mast having an upper end portion, a lower end portion and a central portion therebetween;
(b) a sail having a luff portion attached to the mast and trailing edges extending rearwardly from the luff portion to a rear apex;
(c) a wishbone boom extending from forward of said mast to aft of said rear apex of said sail, said boom having a forward end region disposed forward of said mast, and an aft end region disposed aft of said rear apex, and intermediate portions therebetween;
(d) a first means for connecting the luff portion of said sail to the forward end region of said boom, said connecting means allowing rotation of said boom out of a plane perpendicular to the mast;
(e) a second means for connecting the rear apex of said sail to the aft region of said boom; and
(f) stays connecting the upper end portion and the lower end portion of said mast to the intermediate portions of said boom, whereby said boom is positioned in a plane generally perpendicular to said mast.

* * * * *